US007654024B2

(12) United States Patent
Riley

(10) Patent No.: US 7,654,024 B2
(45) Date of Patent: Feb. 2, 2010

(54) SEPARATED WRISTBAND LABEL ASSEMBLY

(75) Inventor: James M. Riley, St. Louis, MO (US)

(73) Assignee: Laser Band, LLC, St. Louis, MO (US)

( * ) Notice: Subject to any disclaimer, the term of this patent is extended or adjusted under 35 U.S.C. 154(b) by 57 days.

(21) Appl. No.: 11/374,273

(22) Filed: Mar. 13, 2006

(65) Prior Publication Data

US 2006/0168861 A1 Aug. 3, 2006

Related U.S. Application Data

(63) Continuation of application No. 10/256,758, filed on Sep. 27, 2002, now Pat. No. 7,047,682.

(51) Int. Cl.
*A44C 5/00* (2006.01)

(52) U.S. Cl. ..... 40/633; 283/75

(58) Field of Classification Search ..... 40/633
See application file for complete search history.

(56) References Cited

U.S. PATENT DOCUMENTS 919,983 A * 4/1909 Walsh ..... 40/530

(Continued)

FOREIGN PATENT DOCUMENTS

GB 960859 6/1964

(Continued)

OTHER PUBLICATIONS

Posey Movable I.D. Bracelet; downloaded from http://www.posey.com/products/4648.html on Aug. 18, 2004.

(Continued)

*Primary Examiner*—Joanne Silbermann
(74) *Attorney, Agent, or Firm*—Thompson Coburn, LLP

(57) ABSTRACT

A business form particularly adapted for use during medical emergencies includes in a first embodiment a wristband/label assembly that is readily separable from a carrier, with the wristband including a single end for looping around a victim's appendage through a cinch and a tab carrying a plurality of labels with the wristband and each label having an identifying indicia such as a bar code printed thereon. The wristband bar code thus becomes associated with the victim and the labels are used to identify items associated with the patient such as his possessions, medical charts, medicines, etc. The wristband may be color coded so that as the medical personnel triage victims they are categorized by color as to their need for medical care, with the color coding thus being readily ascertainable by others as multiple victims are processed. A second embodiment includes a pre-printed form having a tab portion with the bar code labels as in the first embodiment and also a series of tear off tabs for indicating the medical condition of the patient. Additionally, the medical condition tabs may also be bar coded so that the patient's ID and medical condition may both be "swiped" into a data base using bar code information. Once the data is collected, it is conveniently input into a computer with the computer then transmitting the information to a server for display at a web site. The server and related software is fully capable of handling input from multiple computers in real time so that victim information is made available over the internet almost immediately as the victims are processed.

23 Claims, 8 Drawing Sheets

U.S. PATENT DOCUMENTS

| | | | | | |
|---|---|---|---|---|---|
| 922,948 | A | | 5/1909 | Portmore | |
| 1,383,335 | A | | 7/1921 | Penksa | |
| 1,517,456 | A | | 12/1924 | Pulliam | |
| 2,054,227 | A | | 9/1936 | Nichols | |
| 2,553,676 | A | * | 5/1951 | Roos | 281/51 |
| 2,687,978 | A | | 8/1954 | Vogt | |
| 3,197,899 | A | | 8/1965 | Twentier | |
| 3,402,808 | A | * | 9/1968 | Yannuzzi | 206/232 |
| 3,660,916 | A | * | 5/1972 | McDermott et al. | 40/633 |
| 4,078,324 | A | | 3/1978 | Wiebe | |
| 4,179,833 | A | * | 12/1979 | Knodel | 40/633 |
| 4,226,036 | A | | 10/1980 | Krug | |
| 4,565,731 | A | | 1/1986 | Komatsu et al. | |
| 4,612,718 | A | | 9/1986 | Golub et al. | |
| 4,627,994 | A | | 12/1986 | Welsch | |
| 4,682,431 | A | | 7/1987 | Kowalchuk | |
| 4,696,843 | A | | 9/1987 | Schmidt | |
| 4,829,604 | A | | 5/1989 | Allen et al. | |
| 4,854,610 | A | | 8/1989 | Kwiatek | |
| 4,914,843 | A | | 4/1990 | DeWoskin | |
| 4,956,931 | A | | 9/1990 | Selke | |
| 4,978,144 | A | * | 12/1990 | Schmidt et al. | 283/70 |
| 4,991,337 | A | | 2/1991 | Solon | |
| RE33,616 | E | | 6/1991 | Welsch | |
| 5,026,084 | A | | 6/1991 | Pasfield | |
| 5,045,426 | A | | 9/1991 | Maierson et al. | |
| 5,135,789 | A | | 8/1992 | Schmidt | |
| 5,227,004 | A | | 7/1993 | Belger | |
| 5,227,209 | A | | 7/1993 | Garland | |
| 5,311,689 | A | | 5/1994 | Lindsey | |
| 5,318,326 | A | | 6/1994 | Garrison | |
| 5,351,993 | A | | 10/1994 | Wright et al. | |
| 5,370,420 | A | | 12/1994 | Khatib et al. | |
| 5,381,617 | A | * | 1/1995 | Schwartztol et al. | 40/6 |
| 5,383,686 | A | | 1/1995 | Laurash | |
| 5,418,026 | A | | 5/1995 | Dronzek, Jr. et al. | |
| 5,427,416 | A | | 6/1995 | Birch | |
| 5,486,021 | A | | 1/1996 | Laurash | |
| 5,486,436 | A | | 1/1996 | Lakes | |
| 5,509,693 | A | | 4/1996 | Kohls | |
| 5,509,694 | A | | 4/1996 | Laurash et al. | |
| 5,518,787 | A | | 5/1996 | Konkol | |
| 5,524,934 | A | | 6/1996 | Schwan et al. | |
| 5,547,227 | A | | 8/1996 | Laurash et al. | |
| 5,560,657 | A | | 10/1996 | Morgan | |
| 5,586,788 | A | | 12/1996 | Laurash | |
| 5,595,404 | A | | 1/1997 | Skees | |
| 5,598,970 | A | | 2/1997 | Mudry et al. | |
| 5,601,222 | A | | 2/1997 | Haddad | |
| 5,601,313 | A | | 2/1997 | Konkol et al. | |
| 5,630,627 | A | | 5/1997 | Stewart | |
| 5,637,369 | A | | 6/1997 | Stewart | |
| 5,648,143 | A | | 7/1997 | Mehta et al. | |
| 5,653,472 | A | | 8/1997 | Huddleston et al. | |
| 5,662,976 | A | | 9/1997 | Popat et al. | |
| 5,687,903 | A | | 11/1997 | Akridge et al. | |
| 5,765,885 | A | | 6/1998 | Netto | |
| 5,785,354 | A | | 7/1998 | Haas | |
| 5,842,722 | A | | 12/1998 | Carlson | |
| 5,933,993 | A | | 8/1999 | Riley | |
| 5,984,363 | A | | 11/1999 | Dotson et al. | |
| 6,000,160 | A | | 12/1999 | Riley | |
| 6,006,460 | A | | 12/1999 | Blackmer | |
| 6,016,618 | A | | 1/2000 | Attia et al. | |
| 6,053,535 | A | | 4/2000 | Washburn et al. | |
| 6,067,739 | A | | 5/2000 | Riley | |
| 6,071,585 | A | | 6/2000 | Roth | |
| 6,155,476 | A | | 12/2000 | Fabel | |
| 6,155,603 | A | | 12/2000 | Fox | |
| 6,159,570 | A | | 12/2000 | Ulrich et al. | |
| 6,303,539 | B1 | | 10/2001 | Kosarew | |
| 6,331,018 | B1 | | 12/2001 | Roth et al. | |
| 6,343,819 | B1 | | 2/2002 | Shiozaki | |
| 6,361,078 | B1 | | 3/2002 | Chess | |
| 6,409,871 | B1 | | 6/2002 | Washburn et al. | |
| 6,438,881 | B1 | | 8/2002 | Riley | |
| 6,510,634 | B1 | | 1/2003 | Riley | |
| 6,517,921 | B2 | | 2/2003 | Ulrich et al. | |
| 6,641,048 | B1 | | 11/2003 | Schintz et al. | |
| 6,685,228 | B2 | | 2/2004 | Riley | |
| 6,748,687 | B2 | | 6/2004 | Riley | |
| 6,807,680 | B2 | | 10/2004 | Sloot | |
| 6,863,311 | B2 | | 3/2005 | Riley | |
| 7,017,293 | B2 | | 3/2006 | Riley | |
| 7,017,294 | B2 | | 3/2006 | Riley | |
| 7,047,682 | B2 | | 5/2006 | Riley | |
| 2002/0176973 | A1 | | 11/2002 | Keiser | |
| 2003/0001381 | A1 | | 1/2003 | Riley | |
| 2003/0003249 | A1 | | 1/2003 | Benim et al. | |
| 2003/0011190 | A1 | | 1/2003 | Ryan | |
| 2004/0128892 | A1 | | 7/2004 | Valenti | |
| 2005/0091896 | A1 | | 5/2005 | Kotik et al. | |
| 2005/0108912 | A1 | | 5/2005 | Bekker | |
| 2006/0236578 | A1 | | 10/2006 | Saint et al. | |
| 2006/0242875 | A1 | | 11/2006 | Wilson et al. | |
| 2006/0261958 | A1 | | 11/2006 | Klein | |
| 2007/0120358 | A1 | | 5/2007 | Waggoner et al. | |
| 2007/0243361 | A1 | | 10/2007 | Riley et al. | |
| 2008/0098636 | A1 | | 5/2008 | Greer | |
| 2009/0094872 | A1 | | 4/2009 | Ali et al. | |
| 2009/0193701 | A1 | | 8/2009 | Greer | |

FOREIGN PATENT DOCUMENTS

| | | |
|---|---|---|
| GB | 2045718 | 11/1980 |
| GB | 2160492 | 12/1985 |
| JP | 5-61777 | 8/1993 |
| JP | 08-190350 | 7/1996 |
| JP | 3032299 | 12/1996 |
| JP | 10-207374 | 8/1998 |
| JP | 2003066849 | 3/2003 |
| JP | 2003157010 | 5/2003 |
| JP | 2003164307 | 6/2003 |
| JP | 2006039209 | 2/2006 |
| WO | 9502877 | 1/1995 |
| WO | WO 96/12618 | 5/1996 |
| WO | 98/23081 | 5/1998 |
| WO | 99/18817 | 4/1999 |
| WO | 02/39412 | 5/2002 |
| WO | 03/003331 | 1/2003 |
| WO | 2004/028826 | 4/2004 |
| WO | 2005/064574 | 7/2005 |
| WO | 2006/007356 | 1/2006 |
| WO | 2007/021375 | 2/2007 |
| WO | 2009099787 A1 | 8/2009 |

OTHER PUBLICATIONS

Avery Dennison DuraCard™.

Avery® Laminated Identification Cards #5361.

Brochure entitled: "Color-Bar® Click Strip™ Label System"; Smead Manufacturing Company; Date Unknown; Form No. SSS-CS-00.

Brochure entitled: "Color-Bar® Folders"; Smead Manufacturing Company; Date Unknown.

Brochure entitled: "Integrated Document Management Software"; Smead Manufacturing Company; Date Unknown; Form No. SLI-95.

Catalog entitled: "Reseller Catalog Number One"; Smead Software Solutions™; Date Unknown; Form No. SSS-RC1-00.

Sample of Standard Register Labels.

Standard Register, *P.S. Magazine*, Fall 1998, Dayton, Ohio.

Gretchen Berry, "Wrist Watch," *Advance for Healthcare Information Professionals*, Feb. 15, 1999.

Sample of Standard Register Label.

"Yes, Sir, That's My Baby!," *Material Management in Health Care*, Feb. 1999, vol. 8, No. 2, Health Forum, Inc.
Disaster Management Systems, Inc., Triage Tag, Copyright 1996, Pomona, California.
Maryland Department of Transportation, Maryland Emergency Medical Services, Triage Tag, Copyright MIEMMS 1999, Maryland.
Patent Cooperation Treaty; Partial International Search Report; May 24, 2005.
International Search Report for PCT/US2009/031979 dated Mar. 9, 2009.
Office Action for U.S. Appl. No. 11/373,923 dated Jun. 1, 2009.
Office Action for U.S. Appl. No. 11/562,114 dated May 6, 2009.
Office Action for U.S. Appl. No. 11/735,078 dated May 28, 2009.
Office Action for U.S. Appl. No. 11/763,615 dated May 6, 2009.
International Preliminary Report on Patentability (Chapter II) for PCT/US2008/059616 dated Jul. 14, 2009.
International Search Report for PCT/US2009/039183 dated Jun. 25, 2009.
Office Action for U.S. Appl. No. 11/456,928 dated Jun. 15, 2009.
Office Action for U.S. Appl. No. 11/553,872 dated Jun. 17, 2009.
Office Action for U.S. Appl. No. 11/553,891 dated Mar. 19, 2009.
Office Action for U.S. Appl. No. 11/203,601 dated Aug. 17, 2009.
Office Action for U.S. Appl. No. 11/754,812 dated Jul. 24, 2009.
Office Action for U.S. Appl. No. 12/026,030 dated Oct. 8, 2009.
Office Action for U.S. Appl. No. 12/252,710 dated Oct. 15, 2009.
Office Action for AU Application 2006280450 dated Sep. 14, 2009.
Office Action for CN Application 200580019868.5 dated Sep. 4, 2009.
Office Action for EP Application 03773060.3 dated Aug. 11, 2009.

* cited by examiner

SEPARATED WRISTBAND LABEL ASSEMBLY

CROSS REFERENCE TO RELATED APPLICATION

This application is a continuation of Ser. No. 10/256,758 filed Sep. 27, 2002, now U.S. Pat. No. 7,047,682 which has been allowed.

BACKGROUND AND SUMMARY OF THE INVENTION

There are many situations where it would be convenient to have available a way to separately identify a person, such as a health care patient, with his/her possessions or other related items with which the person needs to be associated. As this is written, the recent events of the tragedy of Sep. 11, 2001 have provided a glaring example of one such situation. In that situation, it became evident that there was no convenient way to associate people desperately in need of health care with their belongings. Even more horrifying was the need to identify body parts, tag them, their belongings. Even more horrifying was the need to identify body parts, tag them, and assemble some kind of data base that could be used to sort through the confusion and chaos created on that terrible day. Under those circumstances, and many other similar emergency circumstances, the health care workers and the emergency workers are under tremendous time pressure, with protective clothing such as gloves being used to avoid personal danger to themselves, to sort through what is presented to them in the way of victims needing medical attention, their possessions including valuables, and a need to communicate with their family. The environment is usually hostile, with what may be fire, flying debris, collapsing buildings, unbreathable air, etc. which makes it quite different from a usual hospital or other controlled environment and makes handling any "standard" form imminently more difficult.

Another aspect to the situation that must be considered is that it is not uncommon for different care takers to handle a single victim. Generally, when a victim is first attended, he is categorized for the nature and extent of his injuries. Then, in those situations where there is a mis-match between the number of victims and the number of medical personnel, the most severely injured are attended to first and the remainder are treated as time becomes available. This is routine, and an attempt to minimize loss of life in what can be a desperate situation. Thus, it is commonly required to "triage" the victims, and then identify them in some way that makes it immediately apparent to medical workers just what their medical situation is. This sounds easy, but in the chaos of these situations, even with medical personnel who are well trained, there can be lost time in this process and if a good strategy is not used for this classifying, victims can be mis-identified or their status not readily ascertainable after classification, so that the precious time of these "angels of mercy" can be needlessly wasted as they move from one victim to another.

This type of emergency situation creates needs that are unique, beyond the needs of a form intended for use in a clean environment available in an emergency room. As mentioned, medical personnel are usually wearing gloves and in a hurry. Thus, any form that would be used must be adapted to be easily handled with clumsy fingers. There is no time for instruction, so the form must be virtually intuitive for use. There are commonly fluids present, unfortunately most often blood and other body fluids, so the form must be protected. There needs to be a simple, fast, fool-proof way to apply the form to the victim, and his possessions, with a reliable way to link them together. There is a further need to be able to quickly collect the identifying information from the form as it is attached to a victim so he may be processed quickly and the information accurately collected. The identifying information commonly needs to be thought out in advance, and might even be pre-coded to mesh with the triage operation so that merely knowing the identifying information conveys some information about victim medical status. And, there is desirably some flexibility available in use of the form to accommodate different victim conditions.

Still another need exemplified by this tragedy is that of providing information to families and other loved ones. After the September 11 event, it was well publicized that family members and others resorted to walking the streets, following any rumor, visiting geographically separated emergency medical care sites, asking for information if not finding their loved one. This itself caused much anxiety and pain amongst the survivors. While not as critical as getting information about survivors to their families, this inability to assemble information created other problems including the inability to gauge the magnitude of the tragedy. A complete list of the survivors was impossible to assemble for days, even though information was individually available by then. There just was not a convenient way to assemble this information in a common data base. Some attempts were made to use the internet, but inaccuracies abounded and the information posted there was soon being ignored, at least part due to the lack of confidence in that information.

To solve these and other needs in the prior art, the inventor herein has developed a business form in several embodiments and a method that have particular application to these kind of medical emergency situations. Briefly, a first embodiment of the form comprises a carrier sheet of paper stock, with a wristband/label assembly die cut thereinto for separation from the carrier sheet. The paper stock is preferably preprinted with identifying indicia, color coded and covered top and bottom with a layer of protective coating which may preferably be a poly plastic. The wristband/label assembly may be dry adhered to a bottom layer of a carrier film so that it may be readily separated from the carrier without retaining any adhesive. The wristband portion of the assembly may have a tab on one end and a long strap portion which, to be assembled, is wrapped around an object such as a victim's wrist, looped back through a "cinch" comprising a slot in the tab and then adhered to itself by an adhesive portion at the end of the strap portion. The tab preferably has a plurality of individually separable labels die cut thereinto, with each of the labels and the wristband having an identifying indicia which may preferably be a bar code.

In use, the wristband/label assembly is separated from the carrier, carrying the tab filled with labels, and the strap portion. The cinch slot is die cut and formed as the assembly is separated with its filler piece adhered to remain behind with the bottom film carrier sheet. The strap portion has its end covered with a laminated bottom patch so that as it separates it carries with it a peel away covering over its end having the adhesive. After being separated from the carrier, the wristband/label assembly has a protective layer over both its top and bottom for resisting fluid contamination and the tab has a label section which may be perforated for separation from the wristband. Each of the labels are individually separable and carry the identifying indicia. The wristband may preferably be color coded, and the forms may be made in sets with multiple ones of each of a number of different colors. Alternately, color coded, perforated tabs may be provided at the end of the tab portion, such that the medical technician need only separate one or more tabs, leaving as the outside tab the correct one to visually indicate the condition of the victim. A blank tab is preferably provided at the very edge of the tab portion so that no one would mistakenly interpret the failure to separate a tab as a conscious attempt at indicating medical condition. The wristband may be readily applied by wrapping the strap portion about the person's appendage, slipping it through the "cinch" comprising the slot to tighten it about the appendage, pulling it tight, and then folding the strap portion back onto itself for attachment with the adhesive after removing the peel away covering.

In a second embodiment, the wristband/label assembly is pre-printed and formed in its final configuration, with a tab/label portion and a strap portion made from preferably four layers. A top, clear film layer overlies and protects a face stock layer upon which the pre-printed information including bar codes and color "condition" codes applied thereto. A layer of adhesive then joins the face stock to a base film material, again to protect the face stock in use. In either embodiment, more than one slot, or "cinch" point, may be provided to allow for a snug fit to different sized body parts. Also, more or fewer bar coded labels, of smaller or larger size, may be selected for use to suit a designer's preferences or user's needs.

In the method of the present invention, once a form has been applied to a victim, and the victim thus associated with an identifying indicia, and his possessions properly tagged, software pre-loaded into a computer may then receive as much information about the victim as is available. Items of information might include his associated color code (which would preferably be indicative of his medical condition), his name and other demographic information, his statistics such as height, weight, race, etc., more detailed information as to the nature of his injuries or condition, the location where this victim is processed, and other appropriate information. The computer may then go on-line, or be on-line, and the data set up-linked to a web site. A plurality of treatment centers could each be simultaneously processing victims, and transmitting data to the web site for ready access and display to anyone interested in learning about a victim's condition. As a victim's condition changes, updated information could be provided to the web site, although it is considered by the inventor that the present method is most effective in providing early information as fast as possible to the most people. Updated information could be available more directly as a victim's family locates and goes to where treatment is being given. Security in the web site and data links would prevent any mischief from occurring which might compromise the integrity of the data such that families could rely on the information posted.

As can be appreciated by those of ordinary skill in the art, there is unfortunately need for the present invention given the heightened risk of terrorism that the world now faces, and along with that arises an increased need to facilitate not only the quick processing of victims but also the task of collecting and disseminating information about these victims. The present invention addresses these needs, which in actuality are long felt needs exacerbated by our changing times. Accordingly, the foregoing provides a brief description of some of the advantages and features of the present invention. A fuller understanding may be attained by referring to the drawings and description of the preferred embodiment which follow.

DETAILED DESCRIPTION OF THE PREFERRED EMBODIMENT

Figure 1:
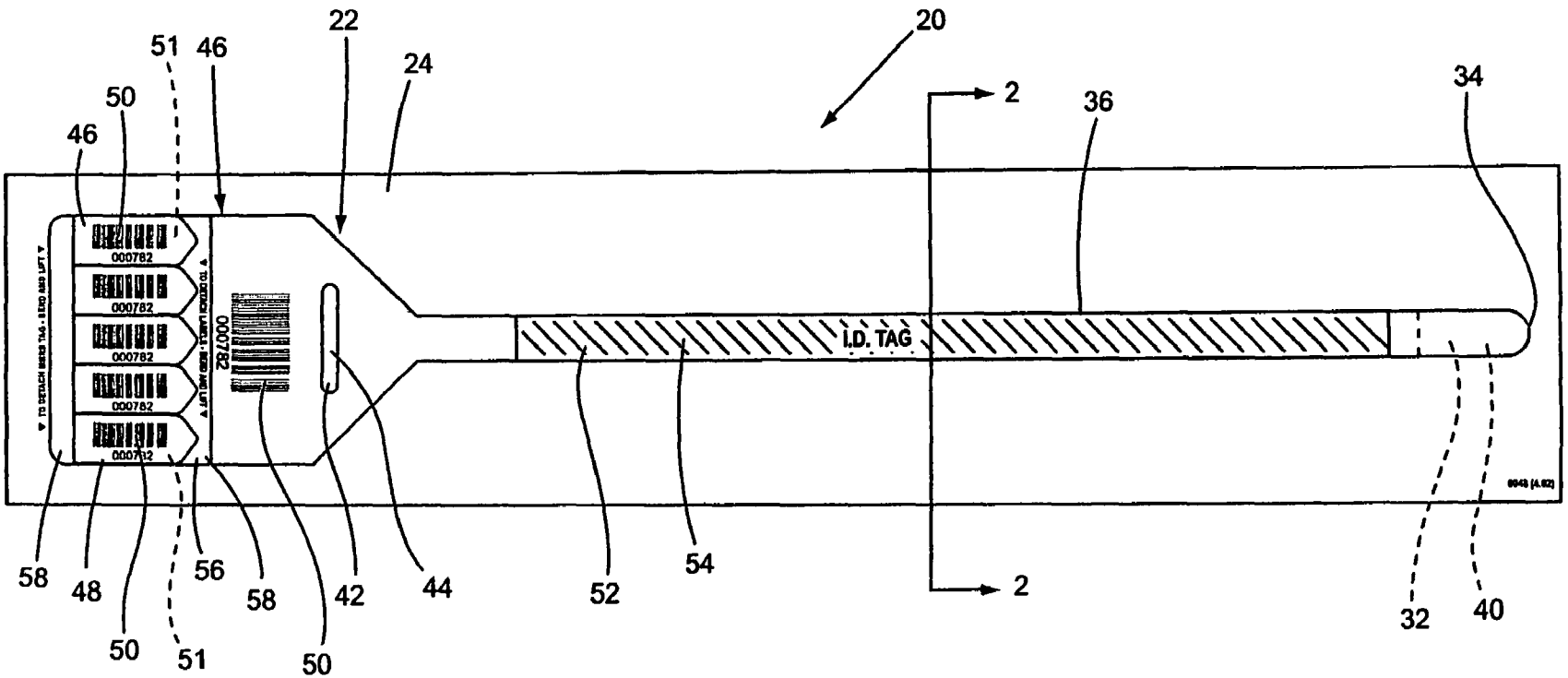
FIG. 1 depicts a top view of the first embodiment of the business form of the present invention prior to the wristband/label assembly being separated from the carrier.
Figure 2:
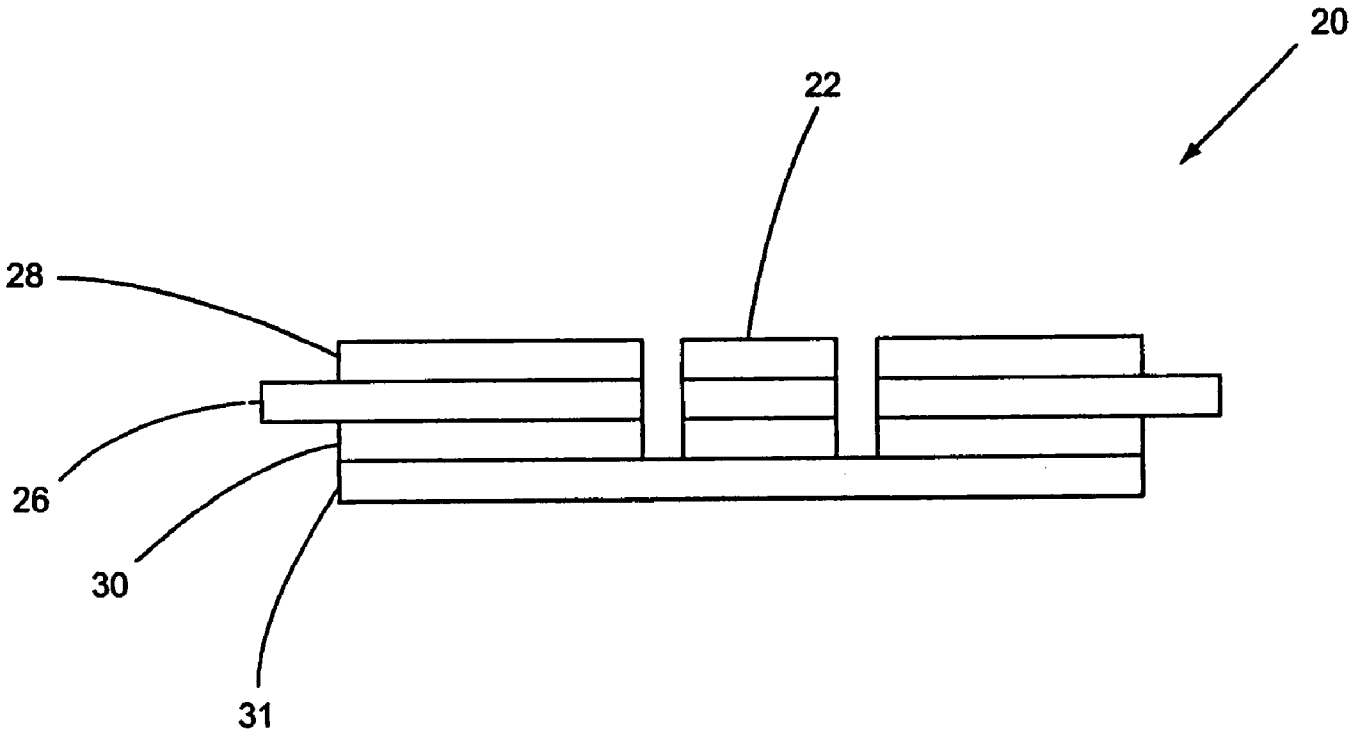
FIG. 2 is a side view of the first embodiment as shown in FIG. 1.
Figure 3:
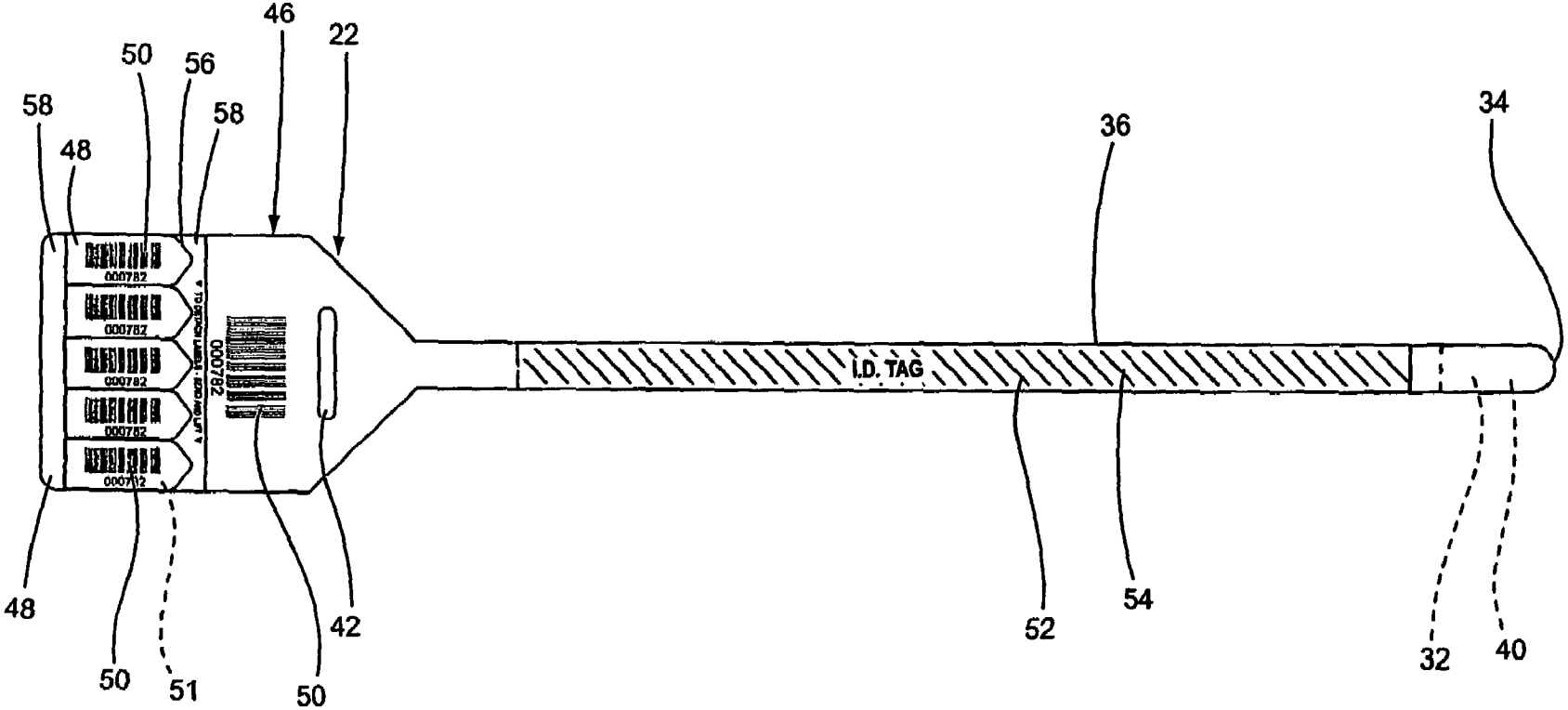
FIG. 3 is a top view of the wristband/label assembly after separation from the carrier of the first embodiment.

As shown in FIGS. 1-3, the first embodiment of the business form 20 of the present invention generally includes a wristband/label assembly 22 die cut into a carrier 24 making an overall size of preferably approximately three and a half inches by seventeen inches, (3½"×17"). Generally, the business form 20 is assembled with a three web construction, with a poly laminated paper center web 26 sandwiched between a pair 28, 30 of thin film poly, transparent webs, and this is then dry adhered to a carrier web 31. The poly coated paper web 26 is dry adhered to the carrier web 31 so that it may be separated therefrom along its die cut to remove the wristband/label assembly 22 from the carrier 24. At an end of the form 20, an adhesive 32 is applied to the single end 34 of the wristband portion 36 of the wristband/label assembly 22. A separate patch 40, preferably made of paper with a release coating, covers the adhesive 32, with the webs die cut so that a portion of the patch 40 covering the adhesive 32 separates with the single wristband end 34 as it is separated from the carrier 24. A "cinch" comprising a slot 42 is formed when the wristband/label assembly 22 is separated from the carrier 24 as a filler 44 remains adhered to the bottom web 30.

The wristband/label assembly 22 of the first embodiment includes a wristband portion 36 and a tab portion 46. The tab portion 46 preferably includes a label portion 56 having a plurality of individual labels 48, each of which along with the body of the tab portion 46 are identified with an identifying indicia 50, preferably a bar code. While five labels 48 are shown, it is apparent to those of skill in the art that a greater or lesser number of labels could be provided in keeping with the scope of the invention. A release layer 51 preferably underlies the labels 48 and facilitates their removal from the tab portion 46 with a layer of adhesive being carried with each label for adhering the label to any other medium, such as a chart, a tag attached to a bag of belongings such as clothes, a medicine container, etc. Preferably, the wristband portion 36 also is color coded, such as with a coloring 52 along strap portion 54 of the wristband. While any convenient color scheme as known in the art may be utilized, one such convenient scheme is to use black for deceased, red for alive and needing immediate attention for survival, yellow for alive and needing attention for recovery, and green for alive and needing attention for non-life threatening injury. Other color schemes would be apparent to those of ordinary skill, and those color schemes are within the scope of the present invention. The tab portion 46 is separated from the label portion 56 by a die cut, thereby allowing for separation of the labels from the wristband portion, should that be desired, but being retained unless intentionally detached. Each of the labels 48 is defined by a die cut, and has a layer of adhesive and an underlying release layer for easy separation of each label 48 individually from the tab portion 46. Surrounding border members 58 may be peeled away from around the labels 48 to make it easier for them to be removed, such as when medical personnel have gloved hands or in the presence of fluids.

Figure 4:
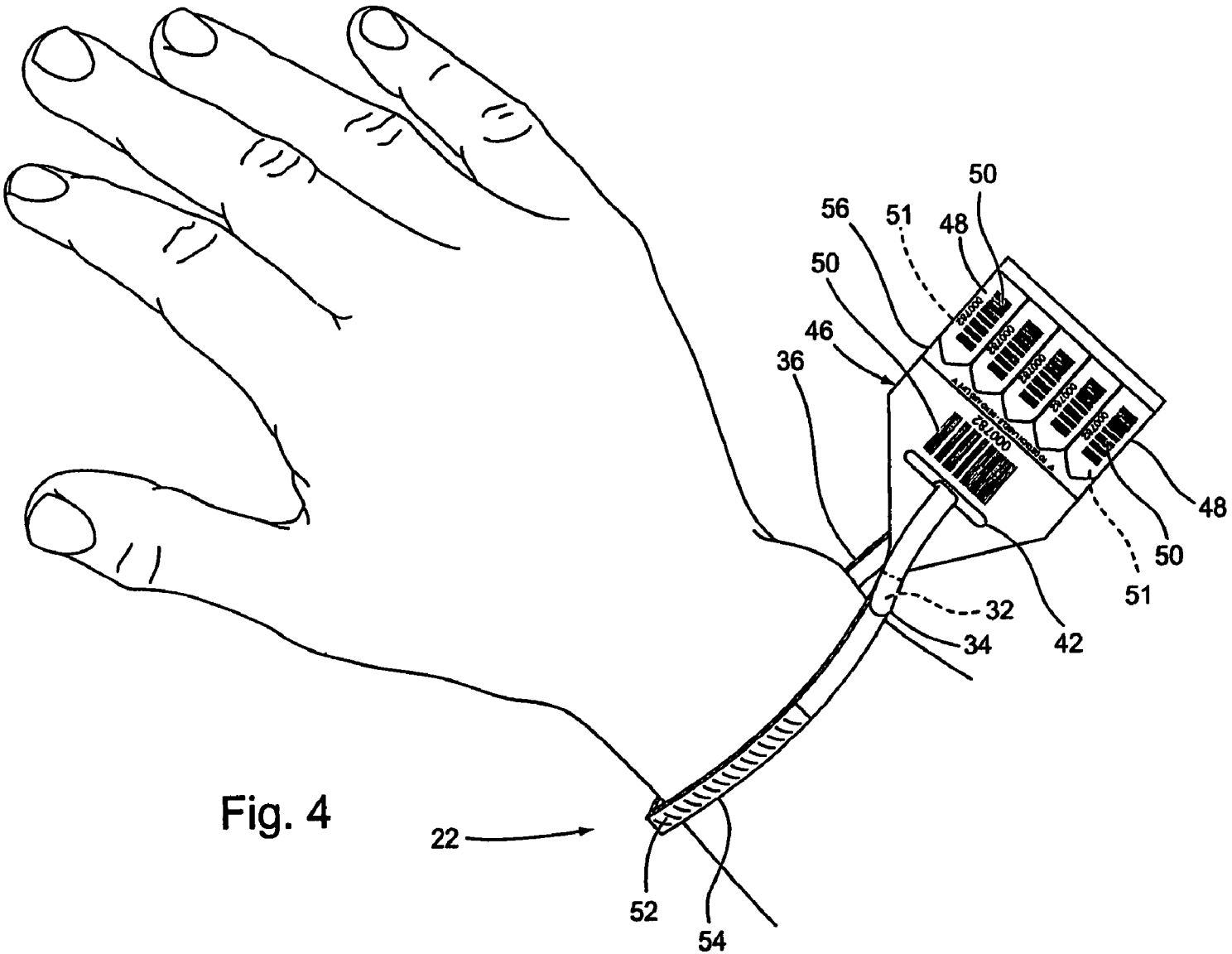
FIG. 4 is a view of the wristband/label assembly applied to a victim's appendage.

As shown in FIG. 4, the wristband/label assembly may be readily applied to a victim, such as around his wrist, by separating it from the carrier, looping the strap portion around the wrist and through the cinch or slot, pulling the strap portion tight as desired, removing the covering over the adhesive applied at the single end of the strap portion, and then affixing the single end to the strap portion to complete the circle or wristband. In this manner, a victim has been color coded as to medical condition, identified with an identifying indicia such as a bar code, and a set of labels have been made immediately available to mark any other items desired to be associated with the victim such as his possessions, his medical charts, medicines being administered, or any other item as desired.

Figure 6:
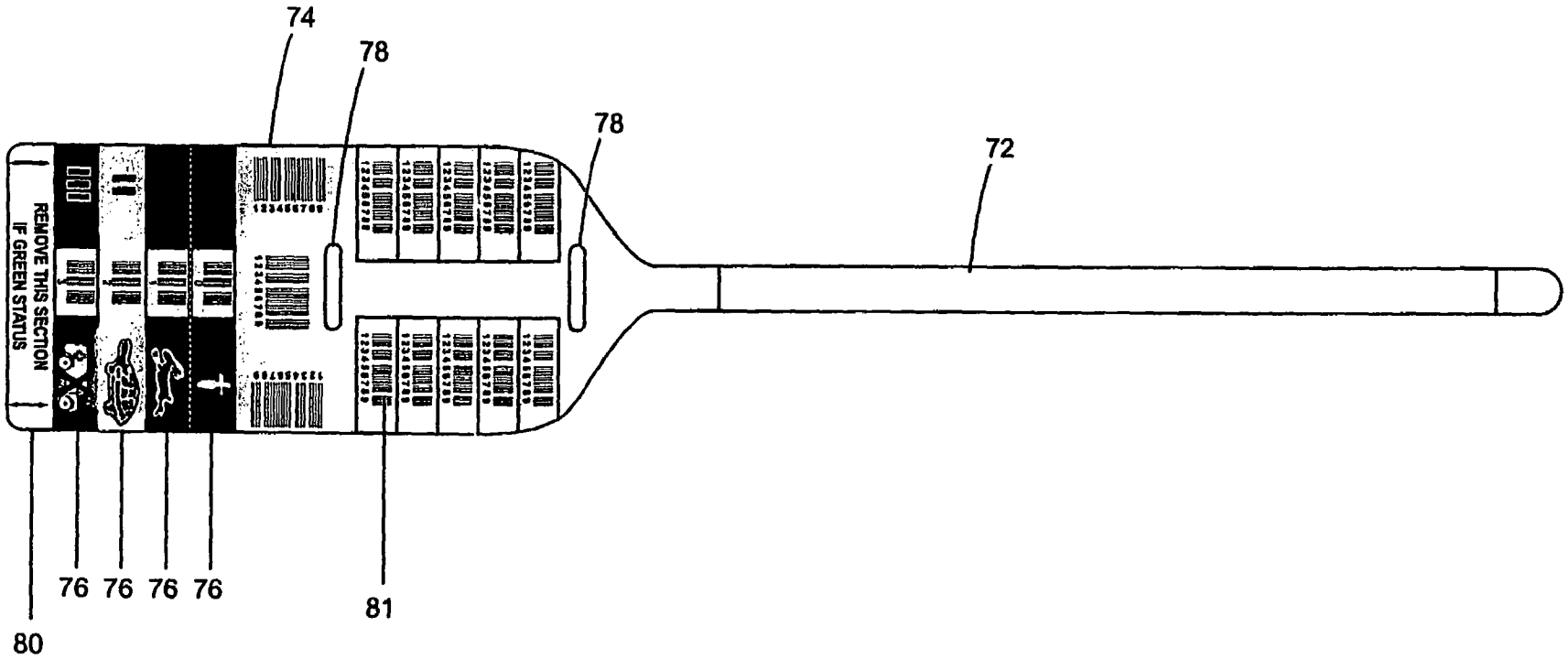
FIG. 6 is a top view of the second embodiment of the business form of the present invention.
Figure 7:
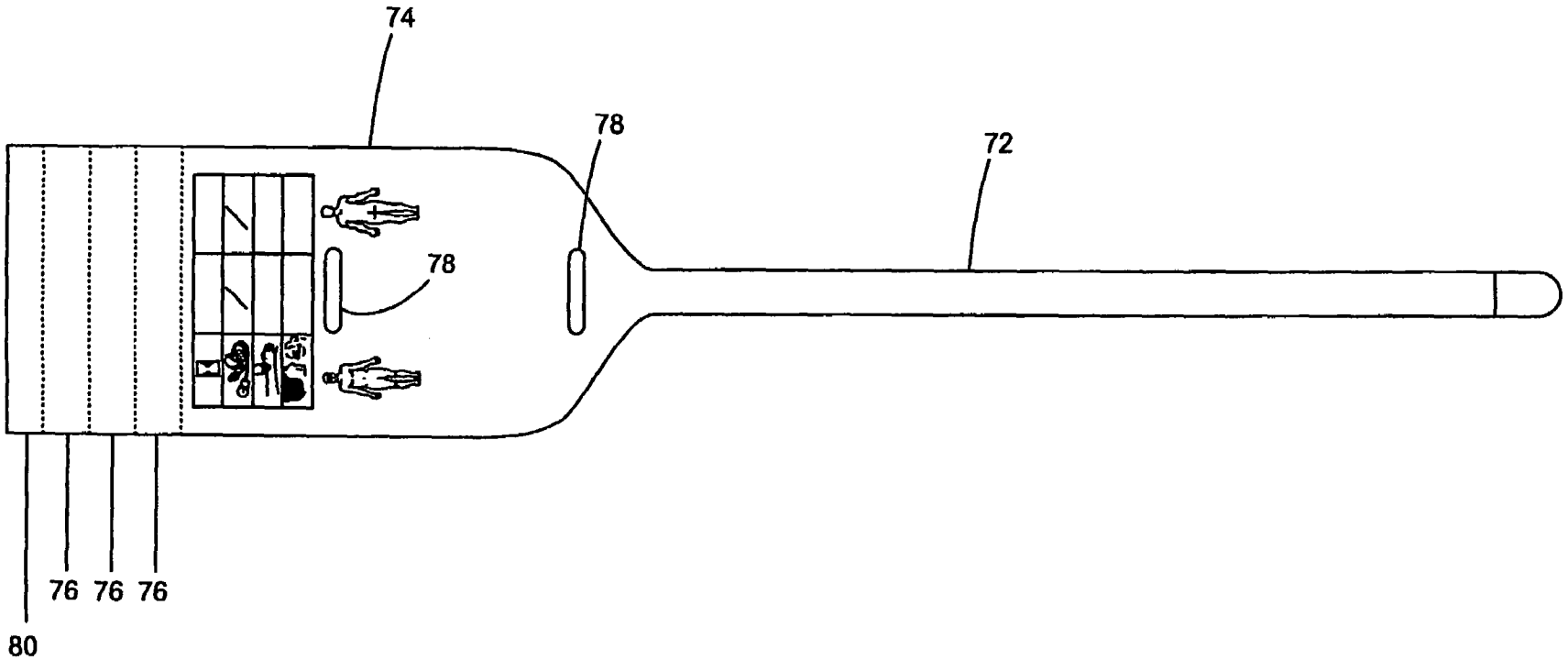
FIG. 7 is a bottom view of the second embodiment.
Figure 8:
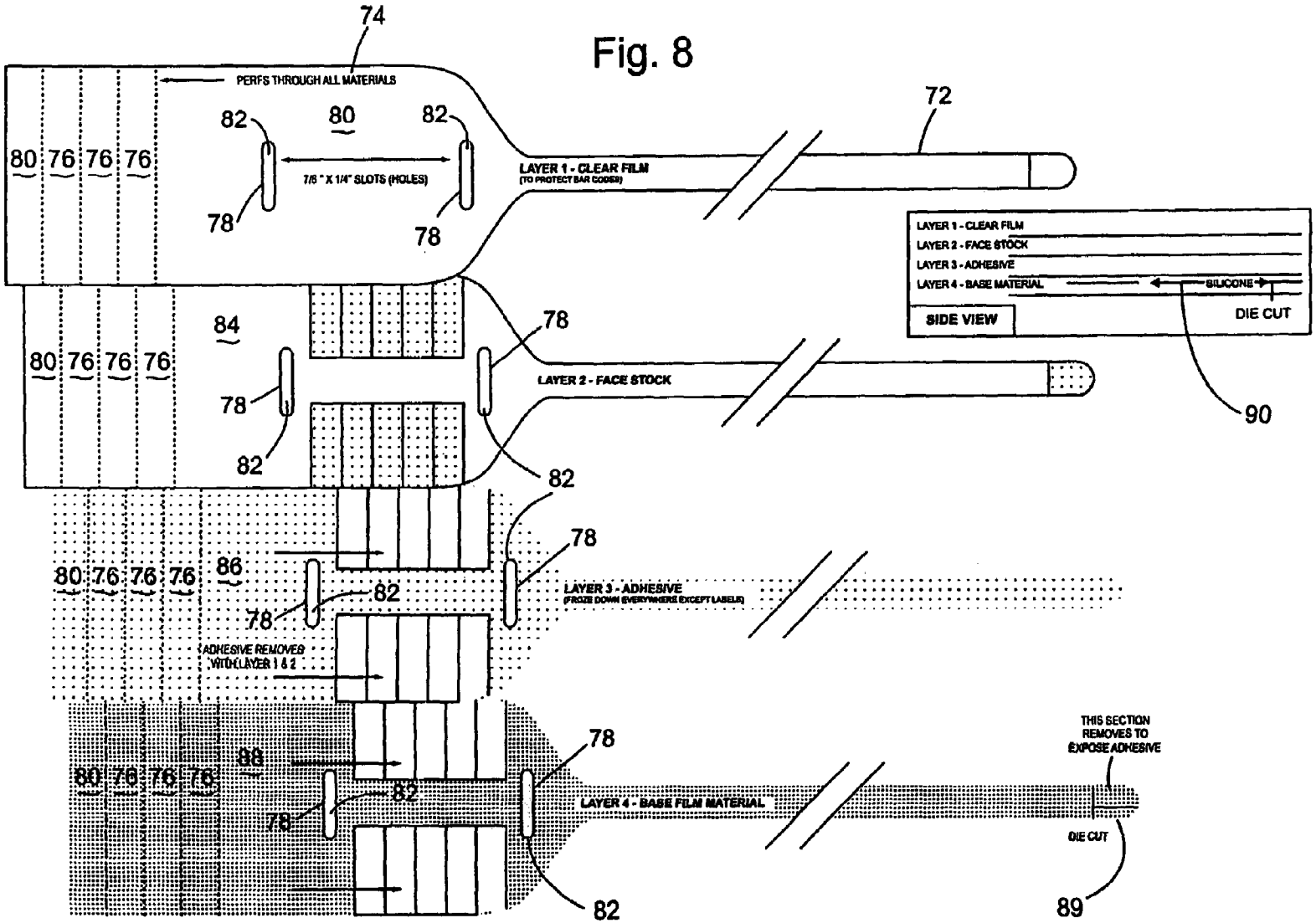
FIG. 8 is an expanded view of the second embodiment, detailing the four layers comprising the second embodiment.

The second embodiment is shown in FIGS. 6-8, and is very similar to the first embodiment except that it is not supplied as part of a sheet type construction from which it must be separated prior to use, is pre-printed, has a different arrangement for indicating medical condition, etc. As shown therein, the second embodiment is completely formed and ready for use without first being separated from a carrier, as with the first embodiment. However, it also has a strap portion 72 and a tab portion 74. While the strap portion may also be color coded, it is preferred that a plurality of separable tabs 76 be provided, along with a dummy tab 80, for separation from the tab portion 74 so that an observer of the applied form may be assured that a conscious effort has been made to indicate medical condition. Otherwise, the dummy tab 80 is present indicating that this feature has not be used, at least as of yet. In addition to color coding, a bar code is also preferably indicated on the individual tabs 76 with each tab 76 having a matching bar code so that the victim's condition may be also scanned into the computer or data base at the same time as the patient's ID bar code. Further information may also be provided on the tabs 76, such as definitional information to instruct a medical technician as to the specific meaning to the various categories to help ensure consistency in marking victims despite the use of multiple and even untrained personnel. This information helps to make the present form almost self teaching as one never knows the quality or training of personnel who will be available when a medical emergency occurs. As shown in FIG. 7, the back of the tab portion 74 may also have additional instructing information, or a place for recordal of vital signs or other medical information such as allergies to medicine or the like. Of further note, as shown in this second embodiment is not one but two cinches 78, comprising slots. This allows the strap portion 72 to be sized more closely to varying dimensions and thus used with a wider variety of appendages. Other similar features are also included such as the bar code labels 81, shown arranged in two columns between the cinch slots 78.

FIG. 8 depicts the four layers used to form the second embodiment, as preferred. The top layer is a web 80 of a clear protective film extending across the entirety of the form, and perforated as noted to allow for the tearing off of tabs 76, 80, and with holes 82 forming the cinch 78. The second layer is comprised of a face stock 84, preferably pre-printed with information as desired with the majority of information contained in the form. The next layer is an adhesive layer 86, preferably a patterned layer and release coating as known in the art as shown, which allows for the removal of tabs 86 with a layer of self adhesive for applying the bar code on ancillary items, as explained in greater detail below. The bottom layer is a web 88 of a base film material which acts to protect the bottom of the face stock web 80. As is noted in the Figures, a patch 89 similar to patch 40 of the first embodiment is shown and which is used to attach the end of strap portion 72 and complete the wristband about the victim's appendage. More particularly, two sections of silicone 90 are shown in a side view inset in FIG. 8, with those sections of silicone lining up with the patch 89 and the bar code labels 81 so that upon separation they carry with them the layer of adhesive making them self adhering.

Figure 5:
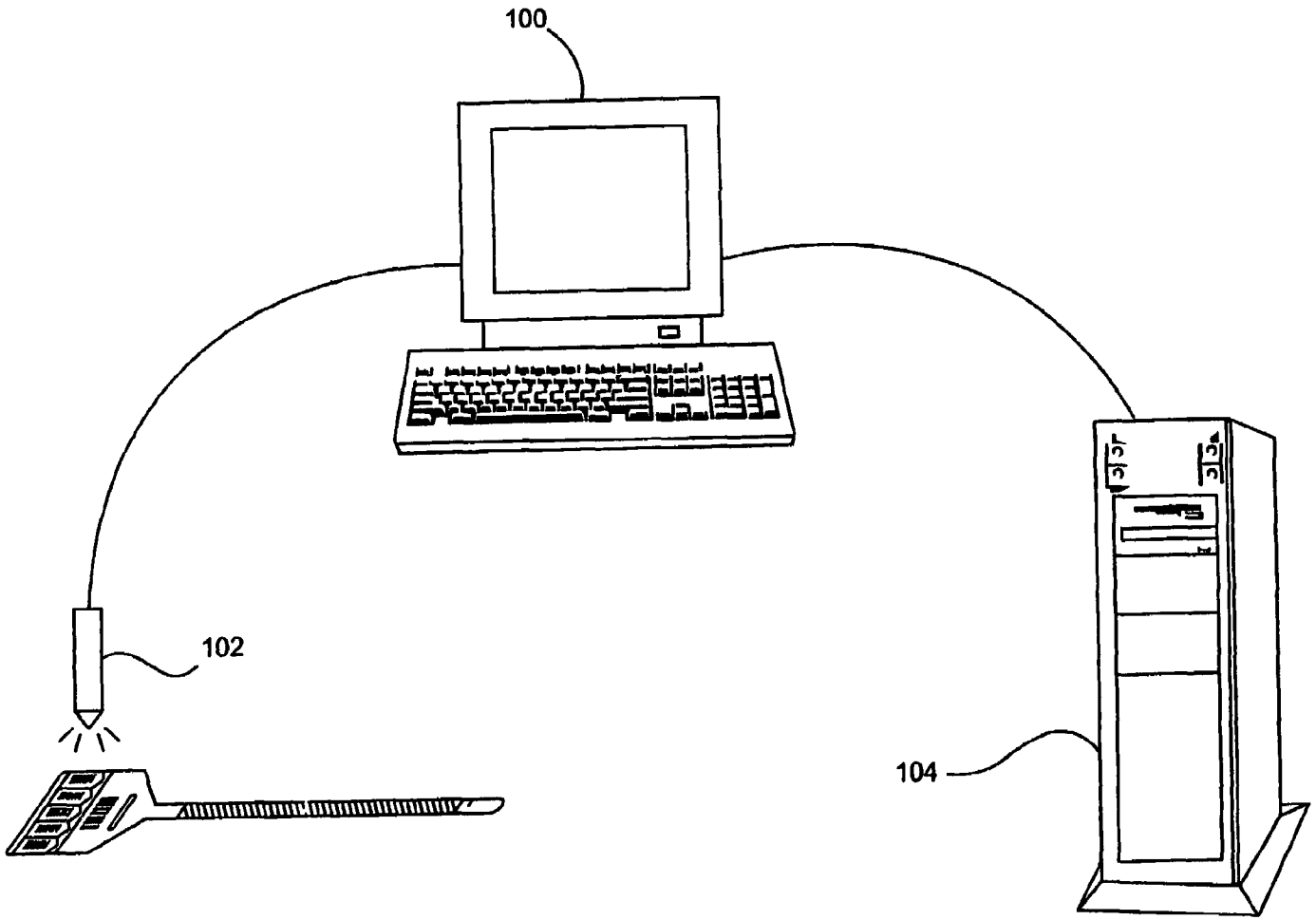
FIG. 5 is a diagram of the computer system used to implement the method of collecting and displaying over the internet the victim data.

As shown in FIG. 5, as the victims are processed, the present invention also contemplates that this information may be input to a computer 100, the bar code being read in with a bar code swiper 102 or the like for preferably both of patient ID and medical condition, and then this information may be transmitted over the internet to a server 104 for collating and display at a web site. Multiple computers 102 could be readily connected to the same server 104, as is known in the art, and handle the input from a number of medical facilities at the same time. This permits this information to be made available almost immediately as victims are processed, through the web and at remote locations, eliminating the anxiety of family members who physically search for their relatives or loved ones.

While the principal advantages and features of the present invention have been illustrated through an explanation of the preferred embodiment, there are other aspects and variations of the invention as would be apparent to those of skill in the art. For example, rather than bar coding, other identifying indicia could be used on the form. The form could be used in other applications other than in emergency situations in the field. Rather than color coding, other coding or indicators could be used to sort victims, or they could be sorted into other categories according to differing medical categories, or coding could be dropped from the form, as desired. Other construction could be used for the form, including especially the wristband portion, such as self laminating construction and the wristband would still be protected from damage during its single use. Other means could be used to attach the wristband rather than looping a single end around and through a slot. Another form of a cinch could be used, or a different arrangement of the cinch. Still other variations would be apparent to those of skill in the art, and the invention is intended to be limited solely by the scope of the claims appended hereto, and their legal equivalents.

What is claimed is:

1. A business form comprising a wristband/label assembly, said business form comprising a wristband configured to have a strap portion for wrapping about a person's appendage as well as an attachment portion for joining together the wristband, said attachment portion comprising an adhesive applied to an end of said strap portion, and a slot, said slot being defined by a line of separation so that as said wristband/label assembly is detached from a carrier the slot is formed, said slot being configured to receive and pass through the attachment portion so that after said wristband/label assembly is detached from the carrier said attachment portion and adhesive may be wrapped around said person's appendage and overlap the strap portion and adhere to another portion of said wristband, thereby completing the attachment of said wristband, and a tab portion comprising a plurality of individually detachable labels, said labels being associated into a label portion, said label portion being adjacent to the tab portion, said wristband and label portion sharing at least one common web in their construction, and further comprising a line of perforation separating the tab portion from the label portion so that the label portion may be separated from the tab portion along the line of perforation, said strap portion and said tab portion being substantially co-planar.

2. The business form of claim 1 wherein said label portion is separable from said wristband.

3. The business form of claim 1 wherein said labels and wristband are configured to accept a common identifier.

4. The business form of claim 3 wherein each of said wristband and labels are pre-printed with a common identifier.

5. The business form of claim 1 wherein said slot is located in said tab portion.

6. The business form of claim 1 wherein each of said labels are detachable by being detached from the common web.

7. The business form of claim 1 further comprising a protective covering for said strap portion adhesive, said protective covering comprising part of the carrier and which is separated therefrom as said wristband/label assembly is separated from said carrier.

8. The business form of claim 7 wherein said wristband/label assembly is adhered to the carrier by a dry release adhesive.

9. The business form of claim 1 wherein said wristband/label assembly is detachable from the carrier in a single assembly.

10. The business form of claim 9 wherein each of said labels are individually detachable from said assembly after said assembly is detached from said carrier.

11. A business form comprising a wristband/label assembly, said business form comprising a wristband configured to have a strap portion for wrapping about a person's appendage, and a tab portion comprising a plurality of individually detachable labels, said strap portion and said tab portion being constructed of a plurality of webs extending substantially the entirety of the length of said wristband, and wherein at least two of said webs are shared by the strap portion and the tab portion, said strap portion having a loose end with an adhesive applied to one side thereof, said tab portion further comprising an integrally formed tab at a strap end opposite its loose end, said tab having a slot through which said loose end is sized to conveniently pass so that the loose end may be adhered to the strap portion to thereby attach the wristband/label assembly to a person's appendage.

12. The business form of claim 11 wherein said labels are each individually detachable.

13. The business form of claim 12 wherein each of said wristband and labels are marked with a common identifier.

14. The business form of claim 13 wherein said slot is defined by a die cut so that as said wristband/label assembly is detached from a carrier the slot is formed.

15. The business form of claim 14 further comprising a cover for the loose end adhesive, said cover forming part of the carrier and detaching with the wristband/label assembly as it is detached from the carrier.

16. The business form of claim 11 further comprising a line of separation separating the wristband from the labels so that the labels may be separated from the wristband after the wristband/label assembly is detached from a carrier.

17. The business form of claim 16 wherein multiple webs are shared by the wristband and the labels, at least one of said webs being a protective laminate web covering the common identifier.

18. A business form comprising a wristband/label assembly, said business form comprising a wristband configured to have a strap portion for wrapping about a person's appendage, an attachment portion for joining together the wristband, and a tab portion, said wristband and tab portion being of multi-web construction and sharing at least two common webs extending substantially the entirety of the length of the wristband, said tab portion comprising a label portion, said label portion comprising a plurality of detachable labels.

19. The business form of claim 18 wherein at least said label portion of said tab portion is separable from said wristband.

20. The business form of claim 19 wherein said attachment portion comprises a slot and a strap, said slot being configured to receive and pass through the strap, and a patch of adhesive on an end of the strap for securing the strap to the wristband after being passed through the slot.

21. The business form of claim 20 wherein said tab portion and at least some of said detachable labels are identified with a common identifier, and wherein said slot is located in said tab portion.

22. The business form of claim 21 wherein said two common webs comprise a face ply and a base ply, each of said face ply and base ply being co-extensive for substantially the entirety of said wristband.

23. The business form of claim 18 wherein said wristband/label assembly is die cut into and separable from a multi-web carrier.

* * * * *